United States Patent [19]

Creates

[11] Patent Number: 4,991,409

[45] Date of Patent: Feb. 12, 1991

[54] OPENABLE RING WITH SAFETY SNAP LOCK ELEMENT

[76] Inventor: Allan B. Creates, 4990 Prince of Wales, Montreal, Quebec H4V 2M9, Canada

[21] Appl. No.: 438,239

[22] Filed: Nov. 20, 1989

[30] Foreign Application Priority Data

Dec. 23, 1988 [GB] United Kingdom ..... 8830050

[51] Int. Cl.[5] ..... A44C 9/00

[52] U.S. Cl. ..... 63/15.7

[58] Field of Search ..... 63/15, 15.7, 15.5, 15.6, 63/15.65, 7; 59/89; 24/573, 5

[56] References Cited

U.S. PATENT DOCUMENTS

| | | | |
|---|---|---|---|
| 1,152,340 | 8/1915 | Obsboum | 63/15.7 |
| 1,637,699 | 8/1927 | Lauterbach | 24/573.5 |
| 2,582,083 | 1/1952 | Tarter et al. | 63/15.7 |

FOREIGN PATENT DOCUMENTS

| | | | |
|---|---|---|---|
| 21413 | of 1902 | United Kingdom | 63/7 |
| 912169 | 12/1962 | United Kingdom | 63/15.7 |
| 584404 | 1/1974 | United Kingdom | 63/15.7 |

*Primary Examiner*—James R. Brittain

*Attorney, Agent, or Firm*—Roland L. Morneau

[57] ABSTRACT

A finger ring made of two arcute segments hinged together at one end of the segments are adapted to be locked with a clasp at the other end. The clasp is hingedly mounted on one segment and adapted to hook onto a transversal rod fixed on the other segement. A circumferential leaf spring fixed on the one segment adjacent the clasp, resiliently maintains the clasp in a position projecting at the free end of the one segment. Another similar leaf spring is positioned at the hinged end of the segements for resiliently maintaining the latter in a substantially circular relationship and firms up the action to snap open and snap shut the segments.

7 Claims, 4 Drawing Sheets

OPENABLE RING WITH SAFETY SNAP LOCK ELEMENT

FIELD OF THE INVENTION

This invention relates to a finger ring and more particularly to a finger ring wherein the band can be opened to facilitate placing the ring on, and removing it from the finger.

BACKGROUND OF THE INVENTION

Conventional rings having a unisegmental band are often difficult to slide on the finger of the wearer. This problem is aggravated when the user has large knuckles with the result that these type of rings are often worn loose. Loosely worn rings slip around on the finger and can be accidentally lost.

To circumvent this type of problem, various structures having segmentated bands have been proposed. U.S. Pat. Nos. 2,771,753 and 590,817 disclose rings having segmented bands linked by a latch.

However, many types of latches used are detremental to the esthetical appearance of the ring which is crucial in the fine jewelry business.

U.S. Pat. 2,971,354 is another example of a ring having segmented bands. The type of locking device disclosed in this patent is not however safe and could inadvertently open up.

U.S. Pat. 3,566,616 is an example of yet another ring having a separable connection in its band.

However, this locking component requires a special pointed tool for its operation.

SUMMARY OF THE INVENTION

The finger ring is made of two arcute segments hinged together at one end of the segments and adapted to be locked with a clasp at the other end. The clasp is hingedly mounted on one segment and adapted to hook onto a transversal rod fixed on the other segment. A circumferential leaf spring fixed on the one segment adjacent the clasp, resiliently maintains the clasp in a position projecting at the free end of the one segment. Another similar leaf spring is positioned at the hinged end of the segments for resiliently maintaining the latter in a substantially circular relationship.

Accordingly, an object of this invention is to provide a finger ring having a segmented band so that a portion thereof may be pivoted outwardly from the remainder to permit lateral positioning of the band over the finger. The ring may therefore be readily placed on and removed from the finger of a person without the necessity of sliding the ring over the length of the finger, the hinged ring being especially useful in the case of persons having enlarged knuckles where it is difficult to slip a ring over the knuckle portion of the finger.

Another object of this invention is to provide a hinged ring having a secure latching means which guards against possible loss of the ring.

A further object of this invention is to provide a hinged finger ring which comprises one or more spring means which further prevent the possible loss of the ring and which facilitates the operations associated with the introduction and the removal of the ring.

A still further object of this invention is to provide a hinged finger ring in accordance with the previous object which will conform to conventional forms of manufacturing, be of simple construction and easy to use as to provide a finger ring which will be economically feasable, long lasting and relatively trouble free in operation.

Figure 1:
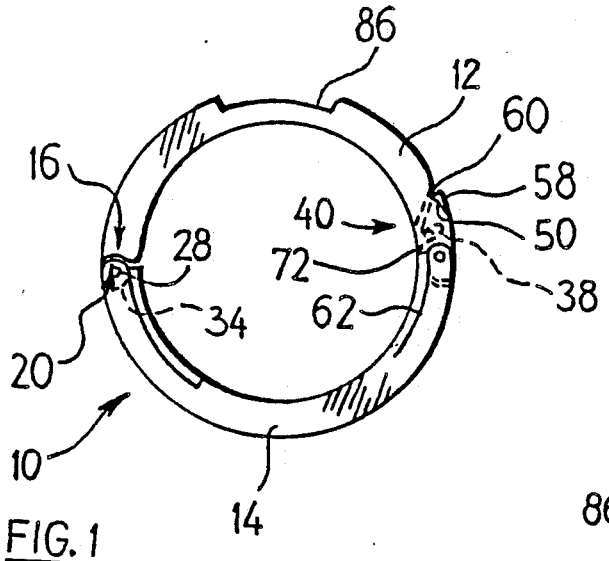
FIG. 1 is an elevational view of a ring with a clasp in a closed position.

Referring to the drawings, the ring comprises a segmented annular band 10 adapted to surround a finger.

The band 10 is formed of a first arcuate segment 12 adapted to receive a setting, stone or other ornementation and a second arcuate segment 14 both segments being usually semi-circular.

The first arcuate segment 12 has substantially concave ends 16 and 18 while the second segment 14 has corresponding substantially convex ends 20 and 22 at its extremities.

The two segments 12 and 14 are hinged together at their respective ends 16 and 20 by a tongue 24 which projects from the concave end 16 of the first segment 12 and which is overlapped by a bifurcated structure 26 provided at the end part 20 of the segment 14.

The two segments 12 and 14 are secured together by a transversal pivot pin 28.

Figure 2:
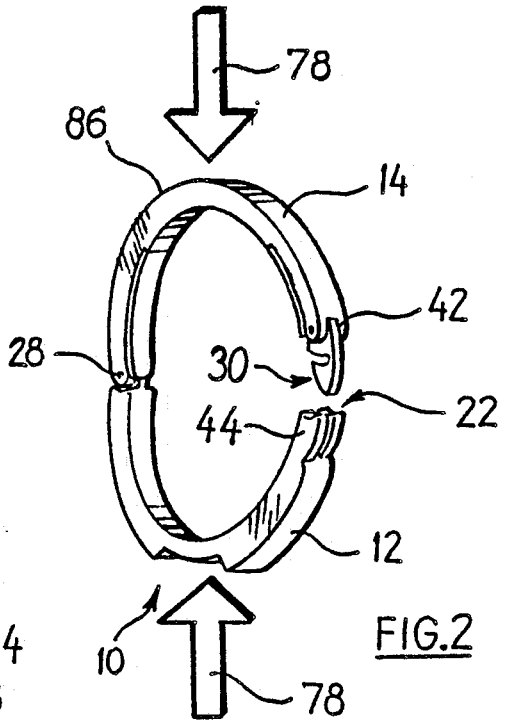
FIG. 2 is a top perspective view of a ring with the band in a partially opened position.
Figure 3:
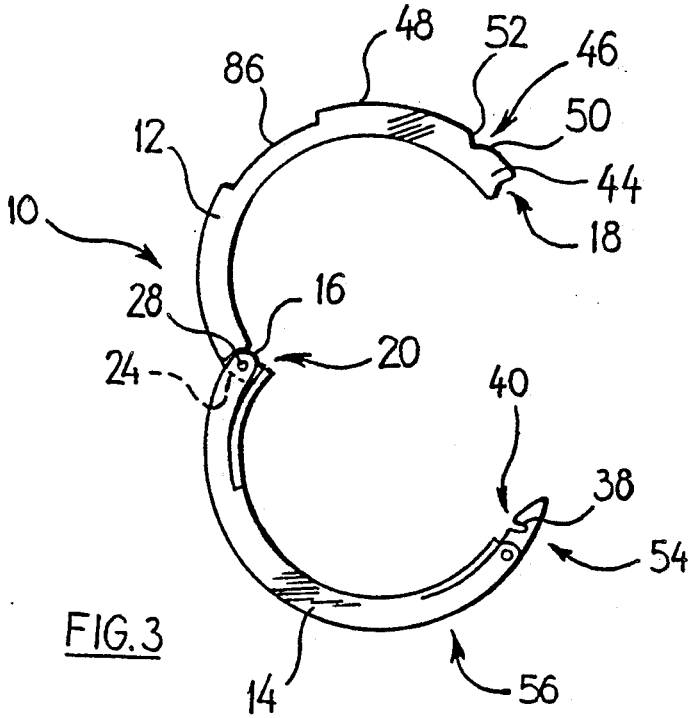
FIG. 3 is an elevational view of a ring with the band in a fully opened position.
Figure 7:
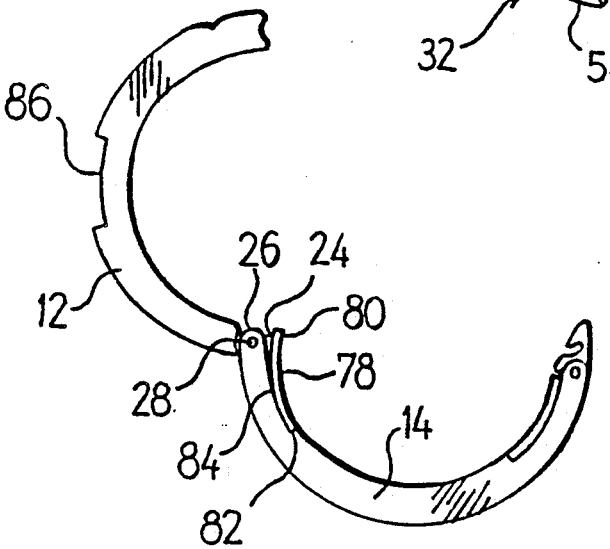
FIG. 7 is an elevational view of a second embodiment of the ring with the band in an opened position.

The second segment 14 can thus be swung outwardly from the first segment 12 as illustrated in FIGS. 2, 3 and 7 allowing insertion of the ring around the finger.

Figure 4:
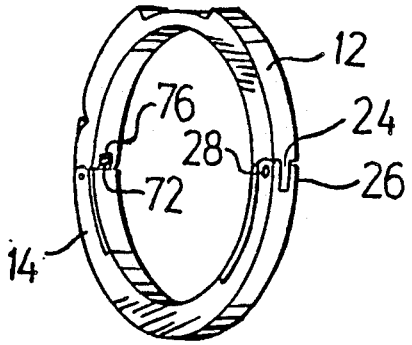
FIG. 4 is a perspective side view of the ring in a closed position illustrating the hinged connection between the two segments and the internal notch on the locking side.
Figure 5:
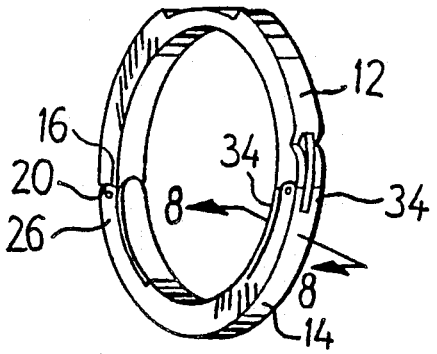
FIG. 5 is a perspective side view of the ring in a closed position illustrating the locking device.

The respective end parts 18 and 22 of the segments 12 and 14 are provided with a releasable locking system 30 for releasably keeping the band 10 in a closed position as illustrated in FIGS. 1, 4 and 5.

The releasable locking system 30 comprises a clasp 32 which is overlapped by a bifurcated structure 34 extending circumferentially at the end 22 of the second segment 14. A pivotal rod 36 pivotally secures the clasp 32 to the second segment 14.

The clasp 32 is provided with a substantially radial locking notch 38 in its inner surface 40 facing inside the annulus. The locking notch 38 is slightly curved relative to a radius of the band 10 to facilitate its engagement and its retention of a locking rod 44.

The end part 18 of the first segment 12 is provided with a bifurcated structure 42 adapted to straddle the clasp 32 when the band 10 is in a closed position.

The locking rod 44 extends across the bifurcated structure 42. The locking rod 44 is adapted to engage inside the curved notch 38 when the band 10 is in a closed position, thus preventing an unwanted opening of the band 10.

Figure 6:
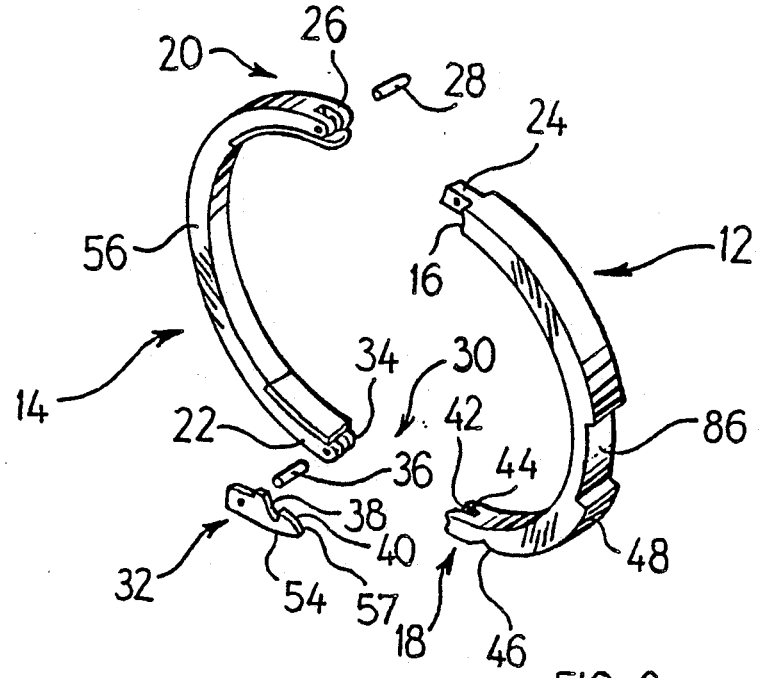
FIG. 6 is an exploded schematic view of the ring.
Figure 9:
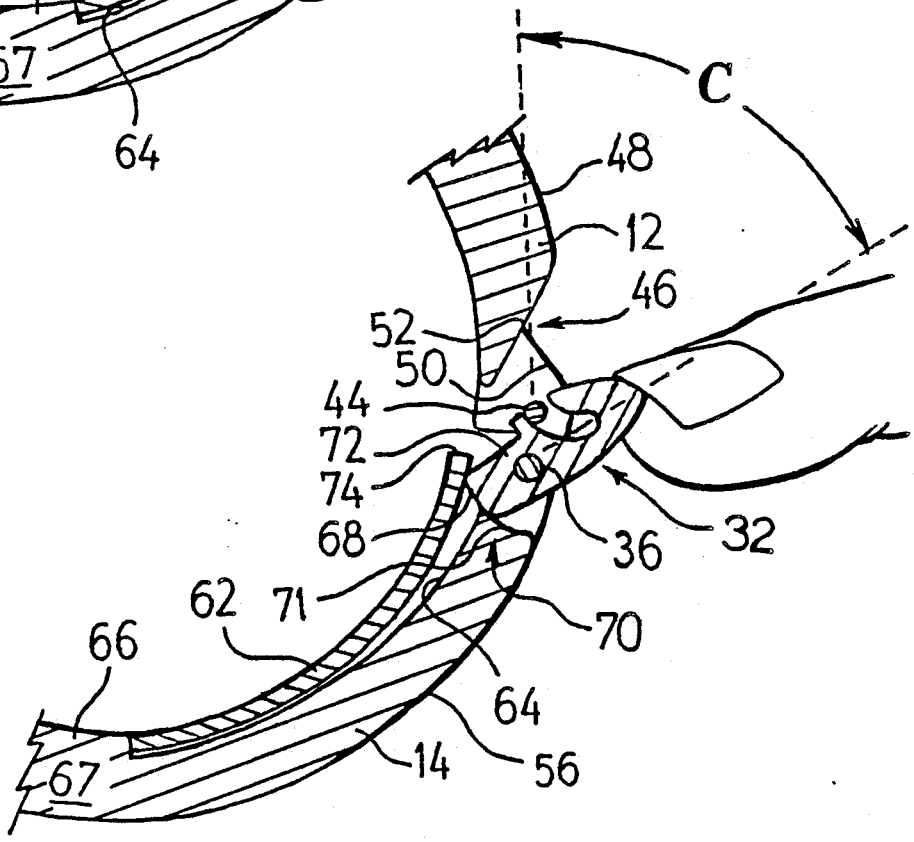
FIG. 9 is a partial cross-sectional view taken along line 8—8 of FIG. 5 with the clasp in an opened position.

The first arcuate segment 12 has a substantially V-shaped radial notch 46 of FIGS. 3, 6 and 9 on its outer surface 48 close to its end part 18. A first surface 50 of the V-shaped notch 46 rides over the bifurcated structure 42 while a second surface 52 of the "V"-shaped notch 46 rides over the body of the first arcuate segment 12.

The outer surface 54 of the clasp 32 has a curvature which closely corresponds to the curvature of the outer surface 48 of the first segment 12 and to the curvature of an outer surface 56 of the second segment 14. Accordingly, when the band 10 is in a closed position with the bifurcated structure 42 straddling the clasp 32, the latter forms a substantially continous curve with the segments as illustrated in FIGS. 1, 5 and 8.

Figure 8:
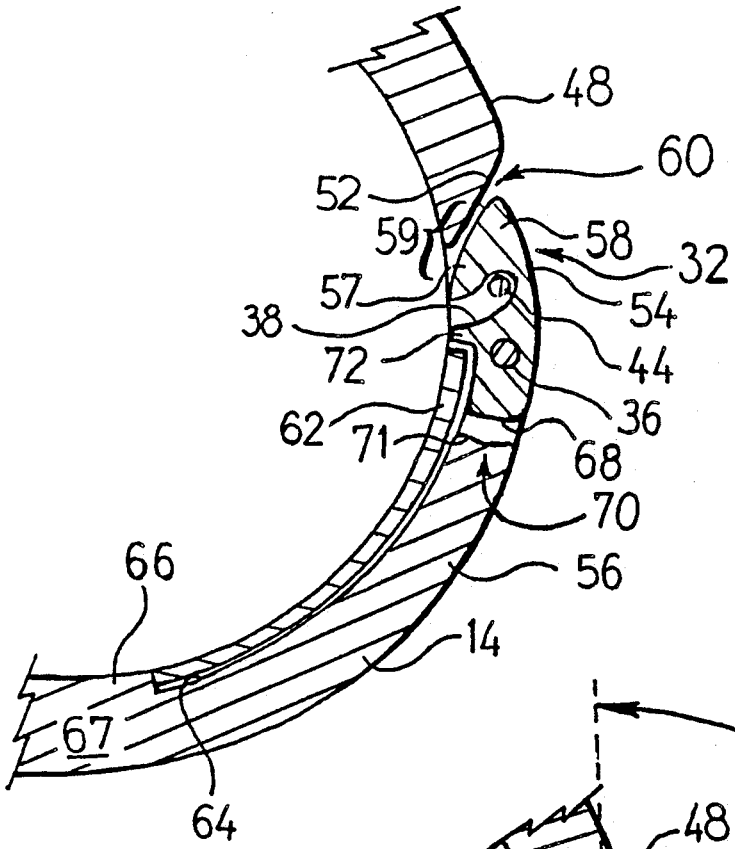
FIG. 8 is a partial cross-sectional view taken along line 8—8 of FIG. 5 with the clasp in a locked position.

Referring to FIG. 8, the inner surface 57 of a top part 59 of the clasp 32 has an arcuate shape which intercepts the outer surface 54 of the clasp 32 thus defining a relatively pointed prehension tip 58. The shape of the top part 59 of the clasp 32 when seen in an elevational view such as FIG. 8 is commonly referred to as a bulletlike shape.

As illustrated in FIG. 1 when the band 10 is in a closed position, the tip 58 of the clasp 32 protrudes through the first surface 50 of the V-shaped notch 46.

In this position, the tip 58 of the clasp 32 and the second surface 52 of the V-shaped notch 46 define a prehension recess 60 clearly visible in FIGS. 1 and 8.

To release the locking system, the user must pivot the clasp 32 outwardly until the locking notch 38 is disengaged from the locking rod 44.

To pivot the clasp 32 outwardly, the user inserts a fingernail 11 (FIG. 9) or another relatively thin object in the prehension recess 60 and pulls on the tip 58 of the clasp 32.

As illustrated in FIG. 9, an additional feature of the present invention resides in a circumferential leaf type spring 62 which biases the clasp 32 towards a relaxed spring position illustrated in FIGS. 1, 3, 4, 5 and 8, whereby the outer surface 54 of the clasp 32 is colinear with the outer surfaces 48 and 56 of the segments 12 and 14.

As illustrated in FIG. 8 the circumferential leaf type spring 62 is formed integral with the second segment 14 and consists of a strip of relatively resilient material which is positioned inside a corresponding recess 64 provided in an inner surface 66 of the second segment 14.

The spring 62 has an end surface 67 which is rigidly linked by welding or other suitable means to the second segment 14.

Referring to FIGS. 8 and 9 the clasp 32 is provided with an abutting end part 68 situated opposite the tip 58. When the tip 58 of the clasp 32 is pivoted outwardly, the abutting end part 68 pivots inwardly thus abutting against the spring 62. The spring 62 thus provides releasable resistance against an unvoluntary pivotment of the clasp 32 which would release the locking system.

As illustrated in FIG. 9, the tip 58 of the clasp 32 is prevented from pivoting outwardly past an angle C of approximately 45 degrees by a slanted back wall 70 between the lateral walls of the bifurcated structure 42. When the clasp 32 is pivoted outwardly, the abutting end surface 68 abuts against the inclined surface 71 of the slanted back wall 70. The surfaces 68 and 71 are shown in their abutting position in FIG. 9 to clearly identify the end of the pivoting action of the clasp 32. In this position, the clasp 32 has a tendency of returning to its closed position due to the spring 62 which is under tension.

An abutting prong 72 extends radially and inwardly from the inner surface 57 of the clasp 32 at a relatively intermediate position between the tip 58 and the abuting end part 68.

The abutting prong 72 abuts against a free end part 74 of the spring 62 when the clasp 32 is in the spring relaxed position illustrated in FIGS. 1, 3, 4, 5 and 8. Accordingly, the upper tip of the spring 62 adjacent the part 74 helps to firm up the position of the clasp 32 in its closed position.

As illustrated in FIG. 4 a relatively small circumferential notch 76 is provided on the inner surface of the second segment 14 at the end part.

The notch 76 houses the abutting prong 72 when the band 10 is in a closed position. The prong 72 therefore also acts to laterally stabilize the two segments 12 and 14.

Another feature of this invention is the case with which the ring can be mounted on a finger.

For closing the band 10 around a finger, from the semi-opened position illustrated in FIG. 2, the user must merely exert pressure on the exterior surfaces of the first and second segments 12 and 14 in the direction of arrows 78.

The locking rod 44 which spans across the bifurcated structure 42, abuts against the tip 58 of the clasp 32. Once pressure is exerted, the inner surface 57 of the top part 59 will slide on the locking rod 44 consequently pivoting the tip 58 outwardly and tensioning the spring 62 until the locking rod 44 reaches the curved locking notch 38 in which it will engage.

The concave shape of the end surfaces 16 and 18 and the convex shape of the end surfaces 20 and 22 have the safety feature of preventing loose skin around the finger from being squeezed during the closing operation of the ring.

The exterior surface 48 of the first segment 12 may be provided with a recess 86 (see FIGS. 1, 3, 6 and 7) which is adapted to receive an ornementation (not shown).

In a further embodiment of the invention, a second circumferential leaf type spring 78 (see FIG. 7) is provided on the inner surface of the second segment 14 adjacent the end part 20 of the segment 14. The leaf spring 78 has a free end 80 and a fixed end 82. The spring 78 is positioned inside a recess 84 and is rigidly welded at its fixed end 82 to the second segment 14.

The free end 80 of the spring 78 overrides the bifurcated structure 26. When the second segment 14 is swung outwardly from the first segment 12 as illustrated in FIG. 7, the tongue 24 resilient abuts against the free end 80 of the spring 78. The end of the tongue 24 facing the second spring 78 is made relatively flat and is oriented to lie flat on the surface of the second spring 78 so as to maintain both segments in a fixed open position.

The second spring 78 therefore provides an additional safety feature against an unwanted opening of the segment 10 which could result in the loss of the ring.

Although the snap lock system has been previously described with the clasp having a prong such as 72 operating in a specific manner. Less elaborate clasps may also be used within the scope of this invention.

Figure 10:
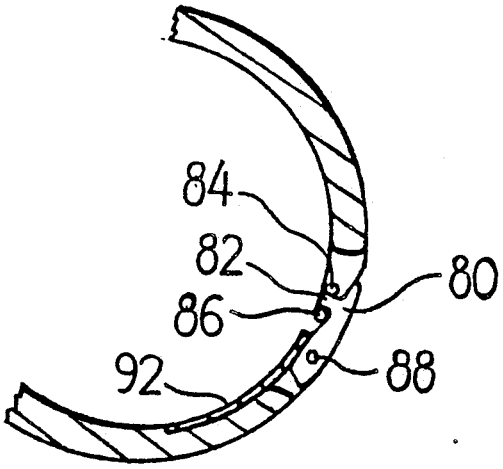
FIG. 10 is a cross-sectional view of part of a ring with a different embodiment of the lock system.
Figure 11:
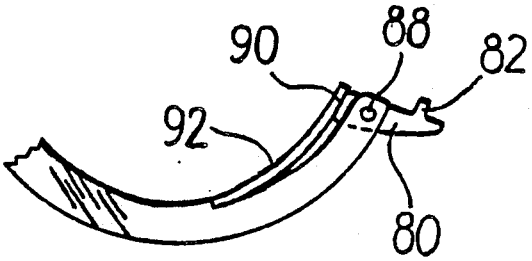
FIG. 11 is a side view of the clasp shown in FIG. 10 in an open position; and, FIG. 12 is a side view of still another embodiment of the lock system.

FIG. 10 shows a clasp 80 having an inwardly projecting nose 82 adapted to be releasably pinched between a pair of transverse rods 84 and 86. The clasp rotates about the axle 88. The end of the clasp, adjacent the axle 88, has a flat face 90 adapted to abut against the spring 92. The flat face 90 lies at about 90 degrees with the longitudinal axis of the clasp 80 which will remain open in a substantially perpendicular direction with the contour of the ring as shown in FIG. 11.

Figure 12:
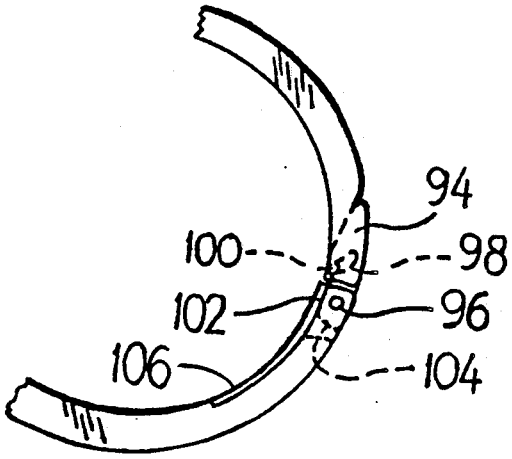

Another embodiment for the locking system is illustrated in FIG. 12. The clasp 94 pivots around the axle 96 to open and close. It is provided with a notch 98 which engages a transversal rod 100. The end of the clasp adjacent the axle 96 has a face 102 which abuts against the spring 106 to maintain the clasp in its closed position. When the clasp is in its open position, face 104 abuts against the spring 106 and maintains the clasp in this latter position.

All the above-described embodiments of the clasps are resiliently controlled by leaf springs mounted along the inner periphery of the ring. Each spring is fixed at one end to one of the segment and is free at the other end. The free end of the spring is adjacent either the lockable end or the hingeable end. The lockable end corresponds to the intersection of the segments 12 and 14 provided with the clasp. The hingeable end corresponds to the intersection of the segments 12 and 14 which are hinged to one another.

I claim:

1. A finger ring shaped to provide an annulus for surrounding a finger, said ring comprising:

a first and a second arcuate segment, each of said segment having an inner circumferential surface, an outer circumferential surface, a hingeable end and a lockable end;

a segment hinge means for adjacently connecting said hingeable end of said first and second segment allowing said first segment and said second segment to pivot relative to one another between an open position allowing lateral insertion of said finger in the ring and a closed position whereby the segments encircle the finger;

a releaseable locking means for hooking together the lockable ends of the first and second segments said releasable locking means comprising;

a clasp being hingedly mounted adjacent the lockable end of the first segment and longitudinally extending from said lockable end of said first segment, said clasp being provided with a radial locking notch defining a curved slot extending through said clasp and opening on the surface of said clasp facing inside said annulus, said clasp having an abutting end portion at the longitudinal extremity closest to the first segment and a prehension tip at the opposite longitudinal extremity, said curved slot extending through said clasp generally in the direction of said prehension tip;

a bifurcated structure extending from said lockable end of said second segment and adapted to straddle said clasp;

a locking rod extending across said bifurcated structure, the clasp being adapted to pivot with respect to the first segment between a closed clasp position whereby the locking rod is engaged inside said radial locking notch for locking said first and second segments in a closed position and an open clasp position whereby said locking rod is released from said radial locking notch, said curved slot adapted to maintain the retention of the clasp on the locking rod by biasedly gripping the latter in the direction of the prehension tip by a portion of said clasp in the closed position defining said curved slot extending radially inward of said locking rod so that said locking rod is maintained in said curved slot;

a circumferential leaf spring positioned in a recess provided in said inner circumferential surface to said first segment, one end of said leaf spring being secured to said first segment and the other end of said leaf spring resiliently abutting said first segment adjacent said bifurcated structure, said other end of said leaf spring also abutting against said abutting end of said clasp for resiliently maintaining the latter in said clasp closed position, the length of said leaf spring at said other end being sufficient to maintain contact with said abutting end of said clasp when the latter is in the open clasp position.

2. A finger ring as recited in claim 1, wherein said clasp further comprises an abutting prong positioned on said abutting end portion of said clasp adjacent the opening of said slot and extending from said surface facing inside said annulus, said abutting prong being adapted to abut against the adjacent peripheral edge of said other end of said circumferential leaf spring for positively stopping the pivoting of said clasp and preventing said prehension tip of said clasp from being pivoted inwardly past said closed clasp portion.

3. A finger ring as recited in claim 2, wherein said bifurcated surface has a pair of lateral walls extending from said lockable end of said second segment and a slanted back wall between said lateral walls, said abutting end portion of said clasp being adapted to abut against said slanted back wall for positively stopping said clasp when said clasp is pivoted away from said closed clasp position at an angle not exceeding about 45°.

4. A finger ring as recited in claim 3, wherein said second segment has a substantially V-shaped radial prehension notch on its outer circumferential surface adjacent said lockable end of said second segment, the peripheral location of said V-shaped notch corresponding to the location of the prehension tip of said clasp in the closed clasp position, said prehension tip having a taper shape extending sideways inside said V-shape prehension notch for defining a recess at the free end of the tip between the latter and the V-shaped notch, whereby said tip is adapted to be retracted from said notch by the introduction of a finger nail on said recess.

5. A finger ring as recited in claim 2, wherein said segment hinge means comprises:

a tongue projecting from said hingeable end of one of said segments;

a bifurcated structure extending from said hingeable end of the other of said segments, said bifurcated structure of said hingeable end being adapted to straddle said tongue;

a transversal pivot pin hingedly connecting said tongue and said bifurcated structure of said segments, and a second circumferential leaf type spring positioned inside a recess in said other segment adjacent said hingeable end and overlapping said bifurcated structure of said done segment, said second spring having a free end, a fixed end, said fixed end of said second spring being rigidly fixed to said other segment and said free end of said second spring being adapted to resiliently abut against said tongue projecting from said one segment for biasing said segments towards said closed position when said segments are in an intermediate position between said open and said closed position.

6. A finger ring as recited in claim 5 wherein said radial locking notch is curved relative to a radius of the annulus for progressively engaging said locking rod.

7. A finger ring as recited in claim 5 wherein said tongue has a relatively flat end surface adapted to lie flat on said second spring for maintaining said segments in said open position.

* * * * *